US005831938A

United States Patent [19]

Sone et al.

[11] Patent Number: 5,831,938

[45] Date of Patent: Nov. 3, 1998

[54] LEAD TERMINAL CONNECTION STRUCTURE OF AN ELECTROACOUSTIC TRANSDUCER

[75] Inventors: Takahiro Sone; Yoshio Imahori, both of Shizuoka, Japan

[73] Assignee: Star Micronics Co., Ltd., Shizuoka, Japan

[21] Appl. No.: 699,062

[22] Filed: Aug. 15, 1996

[30] Foreign Application Priority Data

Aug. 18, 1995 [JP] Japan ..... 7-233312

[51] Int. Cl.[6] ..... H04R 17/00

[52] U.S. Cl. ..... 367/140; 310/314; 310/365; 29/25.35

[58] Field of Search ..... 367/140; 310/314, 310/317, 318, 363, 365; 29/25.35

[56] References Cited

U.S. PATENT DOCUMENTS 5,260,913 11/1993 Kadota et al. ..... 367/140
5,465,186 11/1995 Bajorek et al. ..... 360/113

*Primary Examiner*—J. Woodrow Eldred

[57] ABSTRACT

A lead terminal connection structure of an electroacoustic transducer comprises a lead terminal member having a pair of lead terminals integrated via a bridge piece. The lead terminals have solder surfaces to be soldered to the surface of a circuit board of another device on which an electroacoustic transducer is to be installed. When the lead terminal member is attached to a circuit board of the electroacoustic transducer and the bridge piece is cut, the pair of lead terminals become separate from each other.

16 Claims, 15 Drawing Sheets

LEAD TERMINAL CONNECTION STRUCTURE OF AN ELECTROACOUSTIC TRANSDUCER

BACKGROUND OF THE INVENTION

1. Field of the Invention

The present invention relates to a lead terminal connection structure of an electroacoustic transducer, which connects lead terminals of an electroacoustic transducer such as an electromagnetic type, an electric conduction type or a piezo type, and, more particularly, to a lead terminal connection structure of an electroacoustic transducer, which uses a lead terminal member having a pair of lead terminals previously integrated by a bridge piece and allows those lead terminals to be separated from each other when the bridge piece is cut at a given timing.

2. Description of the Related Art

For example, an electromagnetic type electroacoustic transducer is structured as illustrated in FIGS. 17 and 18. A case 101 has a sound port 103 formed in the center of the left-hand face of the case 101 in FIG. 18, has a support ring 125 provided at the inner peripheral portion on the right side in FIG. 18, and has an opening 107 in the right-hand face in FIG. 18. A base 109 is attached to the opening 107, and a core 111 is secured to the center of the base 109 with a circuit board 113 attached to this center portion.

A coil 115 is wound around the core 111, and has coil ends 115*a* and 115*b* connected via the circuit board 113 to lead terminals 117 and 119 by, for example, soldering as shown by imaginary lines in FIG. 17. Those lead terminals 117 and 119 are connected to the circuit board 113. A ring-shaped magnet 123 is placed around the coil 115 with a ring-like clearance 121 in between. The aforementioned support ring 125 is provided around the magnet 123 and has a step portion 105 at which a diaphragm 126 is provided. This diaphragm 126 comprises an elastic plate (also called a resonance plate) 127 and a magnetic piece 129 attached to the center portion of this elastic plate 127.

The lead terminals 117 and 119 are temporarily secured to the circuit board 113 by an eyelet structure (which provides connection by pressing both ends of a tubular metal fitting inserted into a connection hole), and both ends 115*a* and 115*b* of the coil 115 are soldered to the lead terminals 117 and 119 via the circuit board 113. The lead terminal 117 has a shape as shown in FIGS. 19 and 20. Specifically, the lead terminal 117 has an L shape having a long piece 117*a* and a short piece 117*b*, with a hole 117*c* bored through the long piece 117*a*. An eyelet metal fitting 131 (shown in FIG. 17) is to be fitted in the hole 117*c*. Likewise, the lead terminal 119 has a shape as shown in FIGS. 21 and 22. Specifically, the lead terminal 119 has an L shape having a long piece 119*a* and a short piece 119*b*, with a hole 119*c* bored through the long piece 119*a*. Another eyelet metal fitting 131 (shown in FIG. 17) is to be fitted in the hole 119*c*.

In the thus constituted electromagnetic type electroacoustic transducer, the elastic plate 127 integrally provided with the magnetic piece 129 is attracted by the magnet 123 so that it has a given polarity. When a current flows across the coil 115 via the lead terminals 117 and 119 under this situation, the core 111 is magnetized, generating a magnetic field at the distal end. When the magnetic pole of the core 111 induced by the coil 115 differs from the magnetic pole induced by the magnet 123 attached to the elastic plate 127, the elastic plate 127 is attracted to the core 111. When the former magnetic pole of the core 111 is the same as the latter magnetic pole induced by the magnet 123, the elastic plate 127 repels the core 111. By allowing the current to intermittently flow in either direction, therefore, the elastic plate 127 repeats the above-described operation. In other words, the elastic plate 127 vibrates at a given frequency, thus generating a sound.

This prior art structure has the following shortcoming.

As already explained, after temporarily secured to the circuit board 113 by the eyelet metal fittings 131, the lead terminals 117 and 119 are securely connected to the circuit board 113 by soldering. Since the pair of lead terminals 117 and 119 are separate parts, their positions may shift from the proper ones at the time the lead terminals 117 and 119 are temporarily secured to the circuit board 113 by the eyelet metal fittings 131 or in the subsequent process up to the soldering process. If this misalignment occurs, the proper connection cannot be established.

This will be discussed below specifically. At the time of temporarily connecting the pair of lead terminals 117 and 119 to the circuit board 113 by the eyelet metal fittings 131, the lead terminals 117 and 119 may turn, deviating their attaching angles. FIGS. 23 through 25 illustrate how such deviation occurs. FIG. 23 shows the case where the lead terminals 117 and 119 have shifted in the same direction by approximately the same angle. FIG. 24 shows the case where the lead terminals 117 and 119 have turned in the opposite directions so that the lead terminals 117 and 119 are spread in the / Ψ shape. FIG. 25 shows the case where the lead terminals 117 and 119 have turned in the opposite directions so that the lead terminals 117 and 119 are spread in the Ψ / shape.

Further, the bending angles of the lead terminals 117 and 119 may vary as shown in FIGS. 26 and 27. In this case, the bending angles of both lead terminals 117 and 119 differ from the proper ones and also from each other. The bending positions of the lead terminals 117 and 119 may deviate from the proper positions as shown in FIG. 28. In the illustrated case, the bending position of the lead terminal 119 is higher than that of the lead terminal 117.

In the case where the positions of the lead terminals 117 and 119 are shifted from the proper positions, a problem arises when the electromagnetic type electroacoustic transducer with such mispositioning is installed on a circuit board of another device (e.g., a portable telephone or a pager) 141 and the lead terminals 117 and 119 are respectively soldered to circuit patterns 143 and 145. If the lead terminals 117 and 119 are attached to the proper positions, they are properly secured by soldering to the respective circuit patterns 143 and 145 on the circuit board 141 as shown in FIGS. 29 and 30. The proper soldering means that, as shown in FIG. 29, solder fillets (soldered portions inclining from the circuit board 141 toward the side surfaces of the lead terminals 117 and 119; indicated by "147" in FIG. 29) are provided on the side surfaces of the lead terminals 117 and 119.

If the positions of the lead terminals 117 and 119 are shifted from the proper positions, on the other hand, the solder fillets are not formed. If the lead terminals 117 and 119 are attached in the state illustrated in FIG. 23, they are soldered as shown in FIG. 31. That is, the right sides of the lead terminals 117 and 119 in FIG. 31 are lifted off the respective circuit patterns 143 and 145. If the lead terminals 117 and 119 are attached in the state illustrated in FIG. 25, they are soldered as shown in FIG. 32. That is, the right side of the lead terminal 117 and the left side of the lead terminal 119 in FIG. 32 are lifted off the respective circuit patterns 143 and 145.

If the lead terminals 117 and 119 are attached in the state illustrated in FIG. 24, they are soldered as shown in FIG. 33.

Specifically, the left side of the lead terminal 117 and the right side of the lead terminal 119 in FIG. 33 are lifted off the respective circuit patterns 143 and 145. If the lead terminals 117 and 119 are attached, inclining in the opposite state to the one shown in FIG. 23, they are soldered as shown in FIG. 34. Solder fillets cannot be acquired in this case too.

When an electromagnetic type electroacoustic transducer with the lead terminals 117 and 119 at the improper shifted positions is installed on and soldered to the circuit board 141, the proper soldering cannot be accomplished, causing a conduction failure or reducing the securing power (holding power) to the circuit board 141.

SUMMARY OF THE INVENTION

Accordingly, it is an objective of the present invention to provide a lead terminal connection structure of an electroacoustic transducer which can prevent lead terminals from being mispositioned and can permit excellent soldering when installed on a circuit board, thereby improving the reliability.

To achieve the above objective, a lead terminal connection structure of an electroacoustic transducer according to this invention comprising a lead terminal member having a pair of lead terminals integrated via a bridge piece, the lead terminals having solder surfaces to be soldered to a surface of a circuit board of another device on which the electroacoustic transducer is to be installed, whereby when the lead terminal member is attached to a circuit board of the electroacoustic transducer and the bridge piece is cut, the pair of lead terminals become separate from each other.

The lead terminal connection structure of an electroacoustic transducer according to this invention uses a lead terminal member which has a pair of lead terminals integrated via a bridge piece, to prevent mispositioning of the lead terminals which happens when those lead terminals are originally independent of and separate from each other.

Specifically, the lead terminal member which has a pair of lead terminals integrated via a bridge piece is attached to the circuit board of the electroacoustic transducer. At this stage, the lead terminals of the pair are not yet independent of each other and interact to suppress the positional deviation and prevent the conventional problem of mispositioning. Thereafter, the bridge piece is cut to make the pair of the lead terminals independent of each other.

According to this invention, the lead terminal member having a pair of lead terminals integrated via a bridge piece is used to connect both ends of a coil to the respective lead terminals and then the bridge piece is cut to separate the lead terminals from each other. This structure can therefore prevent the mispositioning of a pair of lead terminals which is likely to occur if the lead terminals are originally independent of and separate from each other. Even if such an electroacoustic transducer is to be installed on a circuit board of another device, therefore, mispositioning of the pair of lead terminals does not occur so that excellent connection can be achieved.

The bridge piece may be provided apart from the solder surfaces of the pair of lead terminals. In this case, when the lead terminals are soldered via the solder surfaces to the surface of a circuit board of another device on which the electroacoustic transducer is to be installed, the cut surfaces of the bridge piece come apart from the solder surfaces, thus avoiding poor solderability.

The solder surfaces of the pair of lead terminals may be formed on the same plane.

The bridge piece may be previously curved or bent so that surfaces of the bridge piece when cut are lifted off the solder surfaces of the pair of lead terminals. In this case too, when the lead terminals are soldered via the solder surfaces to the surface of a circuit board of another device on which the electroacoustic transducer is to be installed, the cut surfaces of the bridge piece come apart from the solder surfaces, thus avoiding a poor solderability.

The lead terminal member may temporarily be secured to the circuit board of the electroacoustic transducer by an eyelet structure, then securely soldered thereto, and then the bridge piece cut.

The electroacoustic transducer may be an electromagnetic type, an electric conduction type, a piezo type or the like, and this invention can be adapted to any type of electroacoustic transducer.

DETAILED DESCRIPTION OF THE PREFERRED EMBODIMENTS

Figure 1:
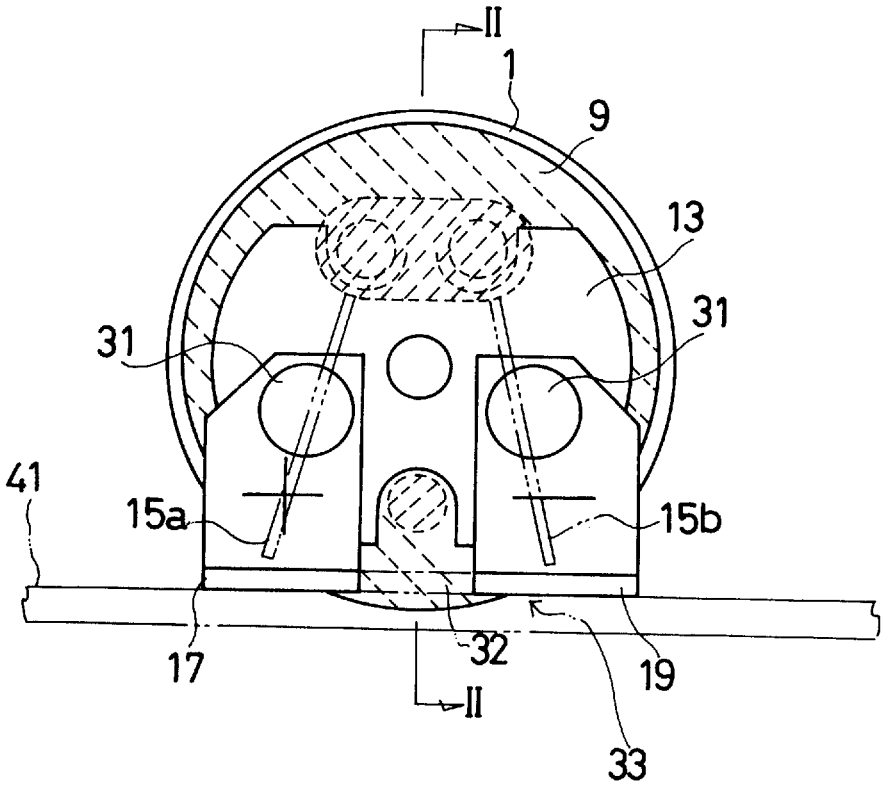
FIG. 1 is a rear view of an electromagnetic type electroacoustic transducer, illustrating the first embodiment of this invention.
Figure 2:
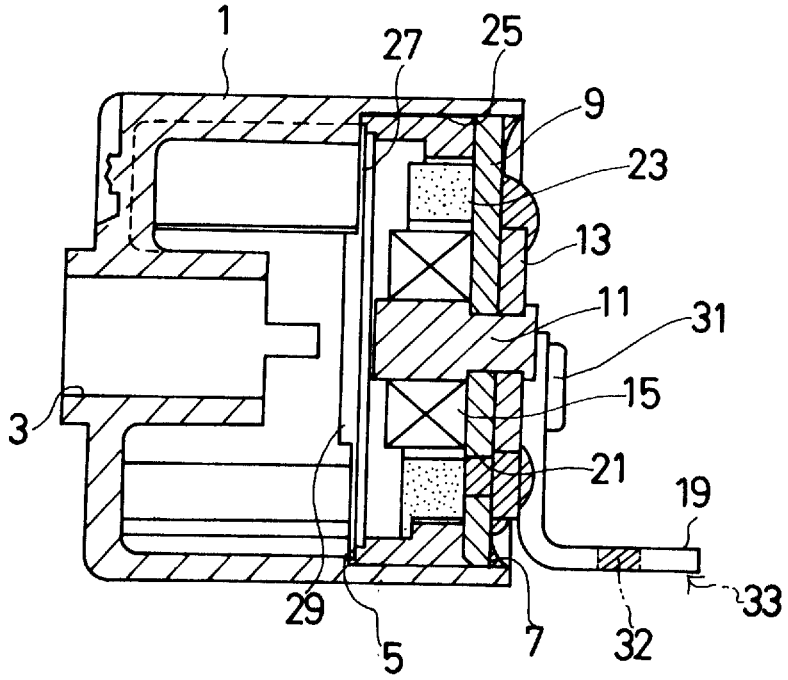
FIG. 2 is a cross-sectional view of the first embodiment of this invention taken along the line II—II in FIG. 1.

The first embodiment of the present invention will now be described with reference to FIGS. 1 through 9. To begin with, the structure of an electromagnetic type electroacoustic transducer which has been assembled by using a lead terminal connection structure of an electroacoustic transducer according to this embodiment will be discussed referring to FIGS. 1 and 2. A case 1 has a sound port 3 formed in the center of the left-hand face of the case 1 in FIG. 2, has a support ring 25 provided at the inner peripheral portion on the right side in FIG. 2, and has an opening 7 in the right-hand face in FIG. 2. A base 9 is attached to the opening 7, and a core 11 is secured to the center of the base 9 with a circuit board 13 attached to this center portion.

A coil 15 is wound around the core 11, and has coil ends 15*a* and 15*b* connected to lead terminals 17 and 19 which are attached to the circuit board 13 as shown in FIG. 1. A ring-shaped magnet 23 is placed around the coil 15 with a ring-like clearance 21 in between. The aforementioned support ring 25 is provided around the magnet 23 and has a step portion 5 at which an elastic plate 27 is provided. A magnetic piece 29 is attached to the center portion of this elastic plate 27.

Figure 3:
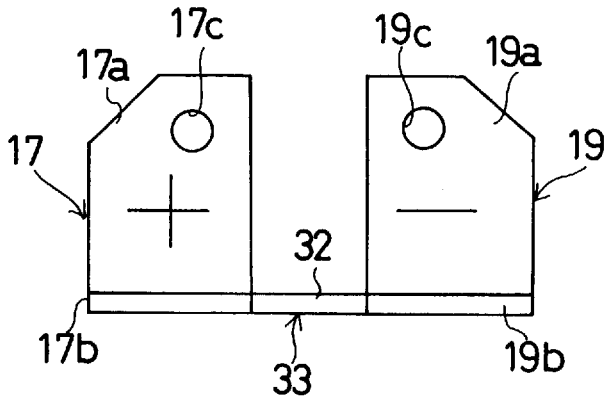
FIG. 3 is a front view of a lead terminal member according to the first embodiment of this invention.
Figure 4:
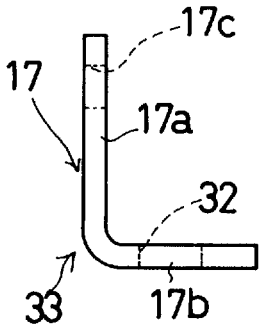
FIG. 4 is a side view of the lead terminal member according to the first embodiment of this invention.
Figure 5:
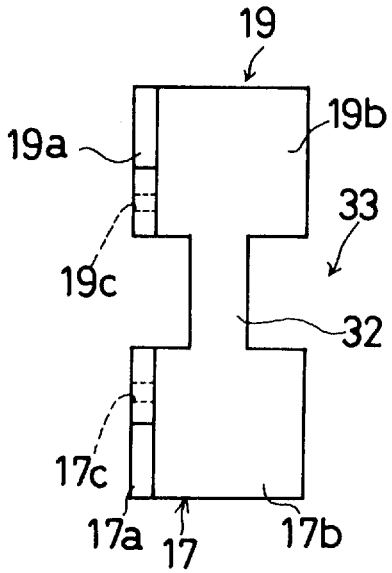
FIG. 5 is a top view of the lead terminal member according to the first embodiment of this invention.

The lead terminals 17 and 19 are modifications of the conventional separate lead terminals 117 and 119 (shown in FIG. 17), which are previously integrated in such a manner that they can be disintegrated at a given timing in the process of assembling an electromagnetic type electroacoustic transducer. The structure of the lead terminal member used in this embodiment will be discussed below. The lead terminals 17 and 19 are originally structured as illustrated in FIGS. 3 through 5. The lead terminal 17 has a long piece 17*a* as the first piece and a short piece 17*b* as the second piece. Bored through the long piece 17*a* is a hole 17*c* through which an eyelet metal fitting 31 is to be fitted. Likewise, the lead terminal 19 has a long piece 19*a* as the first piece and a short piece 19*b* as the second piece. Bored through the long piece 19*a* is a hole 19*c* through which another eyelet metal fitting 31 is to be fitted.

The lead terminal 17 is previously integrated with the lead terminal 19 via a bridge piece 32. The bridge piece 32 is designed in such a way as to bridge the short piece 17*b* of the lead terminal 17 and the short piece 19*b* of the lead terminal 19 at their approximately intermediate positions, as shown in FIG. 5. In this embodiment, the integral lead terminal member 33 with this structure is used in assembling an electromagnetic type electroacoustic transducer.

Figure 6:
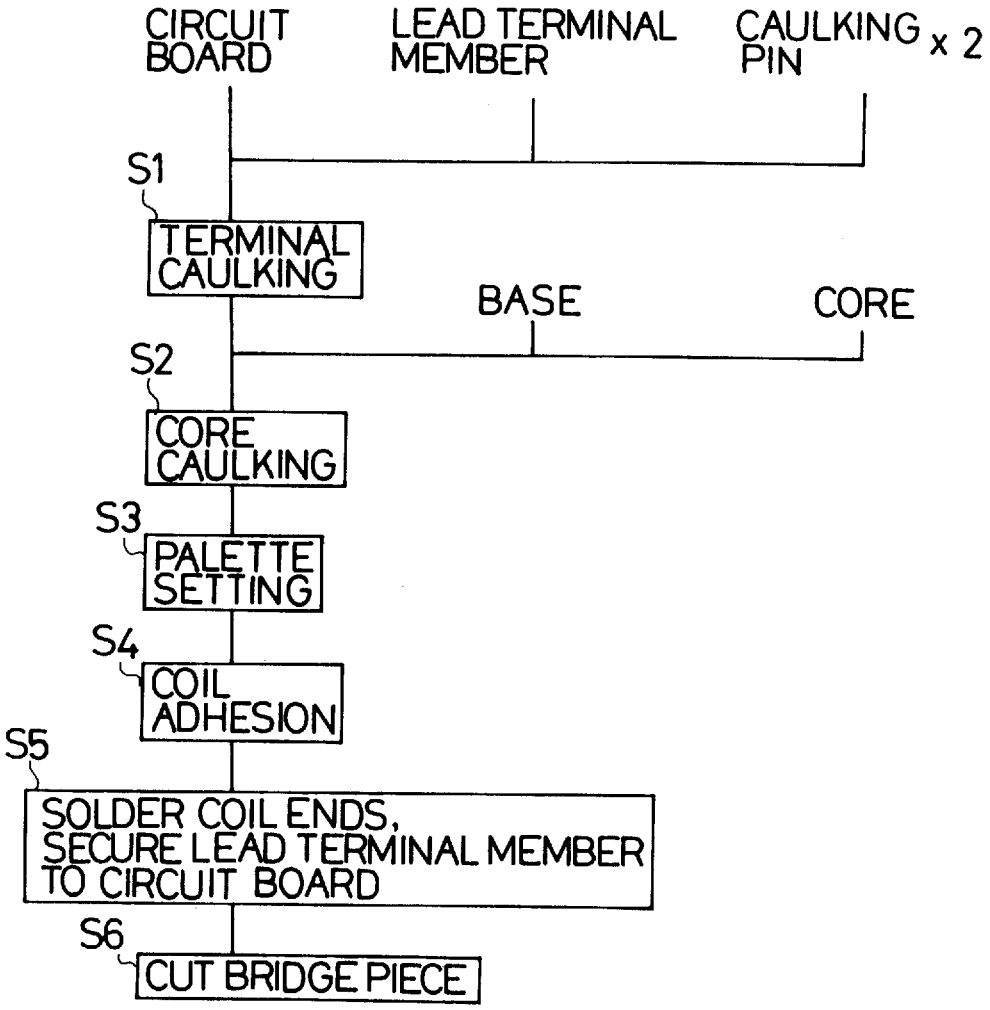
FIG. 6 is a process diagram illustrating a part of a process of assembling an electromagnetic type electroacoustic transducer according to the first embodiment of this invention.
Figure 7:
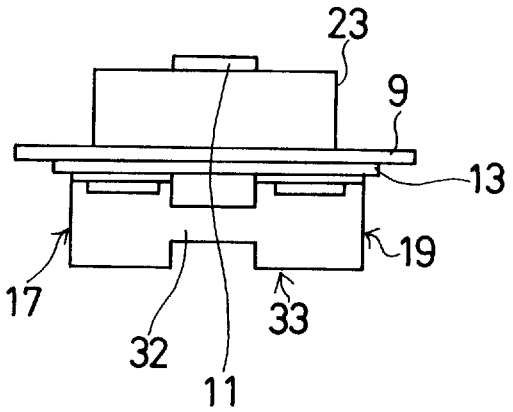
FIG. 7 is a front view of an electromagnetic type electroacoustic transducer showing a state before the bridge piece of the lead terminal member is cut in the process of assembling the electromagnetic type electroacoustic transducer according to the first embodiment of this invention.

Referring now to FIG. 6, a part of the assembling process for an electromagnetic type electroacoustic transducer using the thus constituted lead terminal member 33 will be described. First, the circuit board 13, the lead terminal member 33, and two caulking pins 31 as eyelet metal fittings are prepared, so that the lead terminal member 33 is temporarily secured to the circuit board 13 by a so-called eyelet structure using the caulking pins 31 (shown in FIGS. 1 and 2) (step S1).

As mentioned above, the lead terminal member 33 has the lead terminals 17 and 19 integrated with each other by means of the bridge piece 32.

The process then proceeds to step S2 where the base 9 and the core 11 are securely attached to the circuit board 13. Then, the process moves to step S3 where palette setting is performed.

Figure 17:
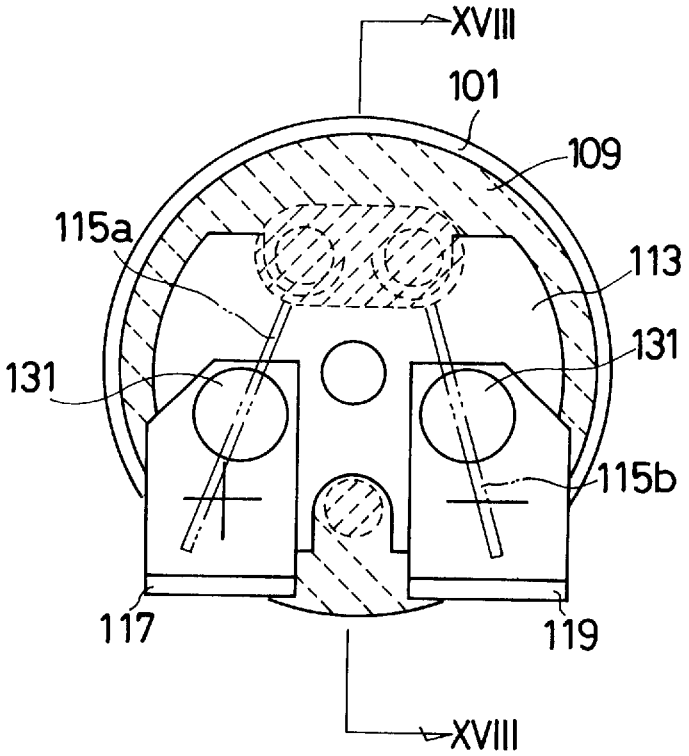
FIG.17 (PRIOR ART)
FIG. 17 is a rear view of an electromagnetic type electroacoustic transducer according to prior art.
Figure 18:
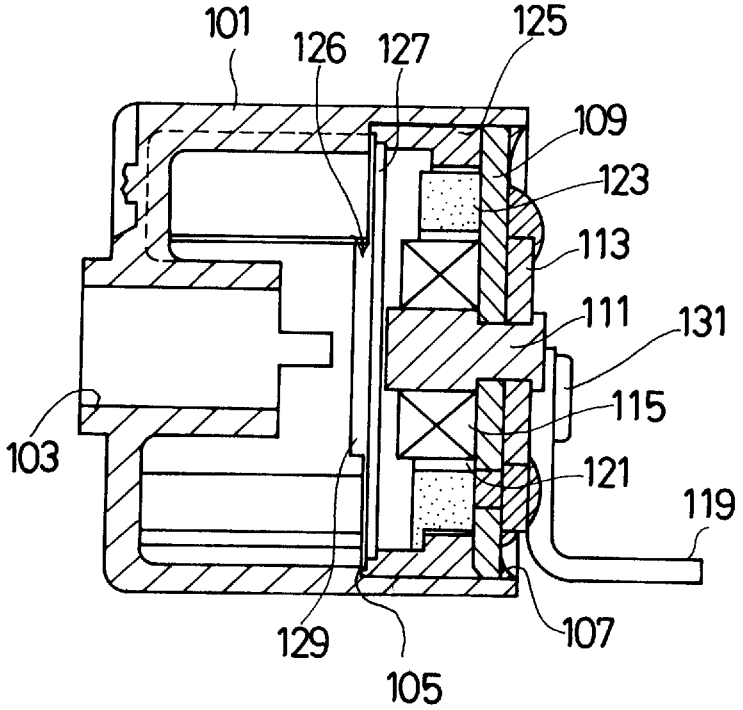
FIG.18 (PRIOR ART)
FIG. 18 is a cross-sectional view of the prior art along the line XVIII—XVIII in FIG. 17.
Figure 19:
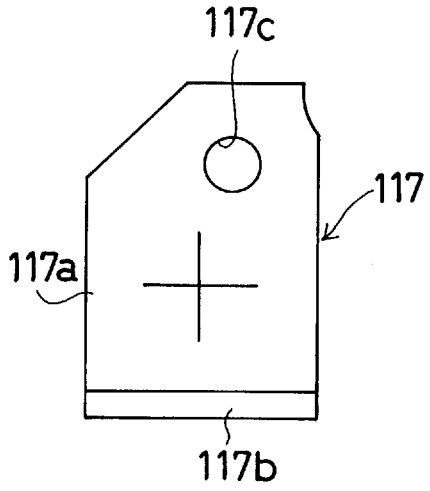
FIG.19 (PRIOR ART)
FIG. 19 is a front view of a lead terminal according to the prior art.
Figure 20:
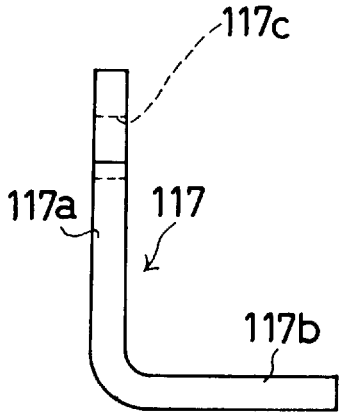
FIG.20 (PRIOR ART)
FIG. 20 is a side view of the lead terminal according to the prior art.
Figure 21:
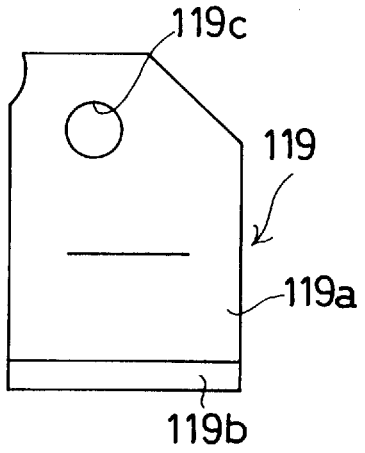
FIG.21 (PRIOR ART)
FIG. 21 is a front view of another lead terminal according to the prior art.
Figure 22:
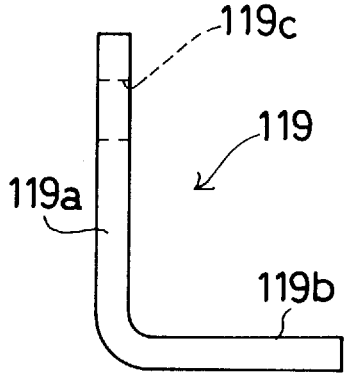
FIG.22 (PRIOR ART)
FIG. 22 is a side view of this lead terminal according to the prior art.
Figure 23:
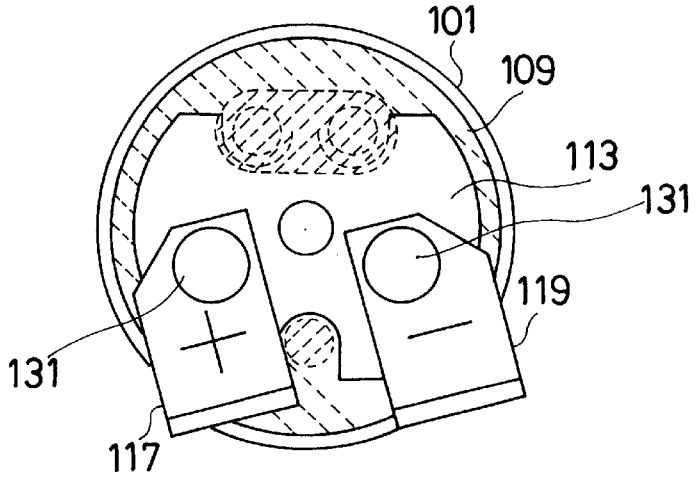
FIG.23 (PRIOR ART)
FIG. 23 is a rear view of the electromagnetic type electroacoustic transducer according to the prior art, showing the positions of the lead terminals shifted from the proper positions.
Figure 24:
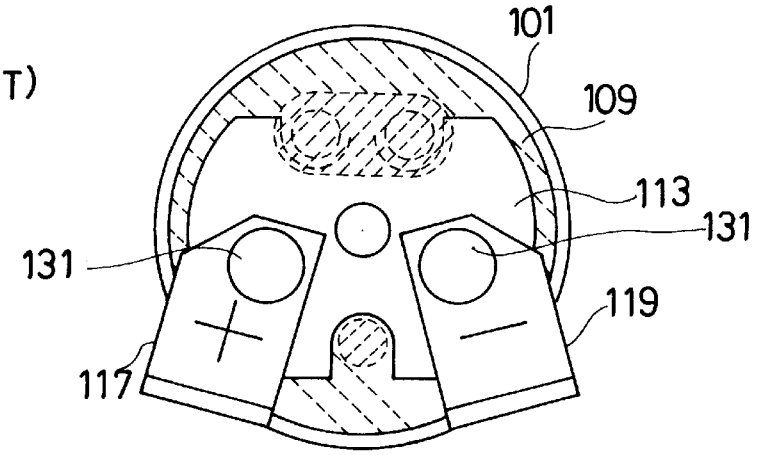
FIG.24 (PRIOR ART)
FIG. 24 is a rear view of the electromagnetic type electroacoustic transducer according to the prior art, showing the positions of the lead terminals shifted from the proper positions.
Figure 25:
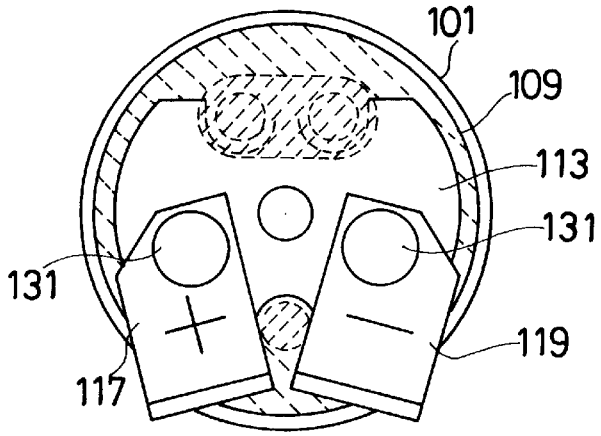
FIG.25 (PRIOR ART)
FIG. 25 is a rear view of the electromagnetic type electroacoustic transducer according to the prior art, showing the positions of the lead terminals shifted from the proper positions.
Figure 26:
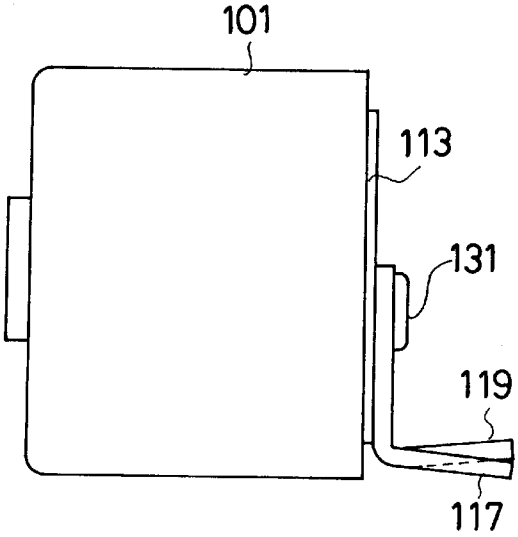
FIG. 26 (PRIOR ART)
FIG. 26 is a side view of the electromagnetic type electroacoustic transducer according to the prior art, showing the positions of the lead terminals shifted from the proper positions.
Figure 27:
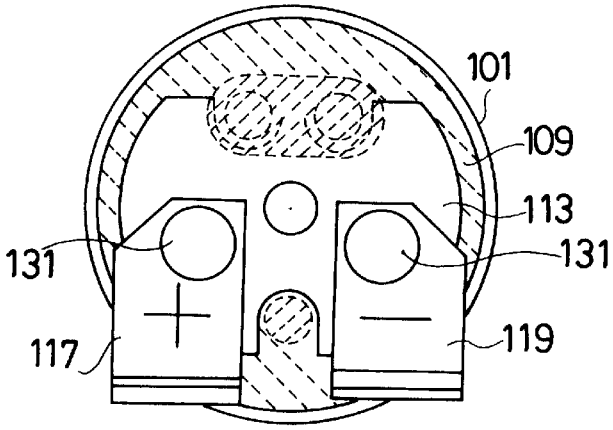
FIG. 27 (PRIOR ART)
FIG. 27 is a rear view of the electromagnetic type electroacoustic transducer according to the prior art, showing the positions of the lead terminals shifted from the proper positions.
Figure 28:
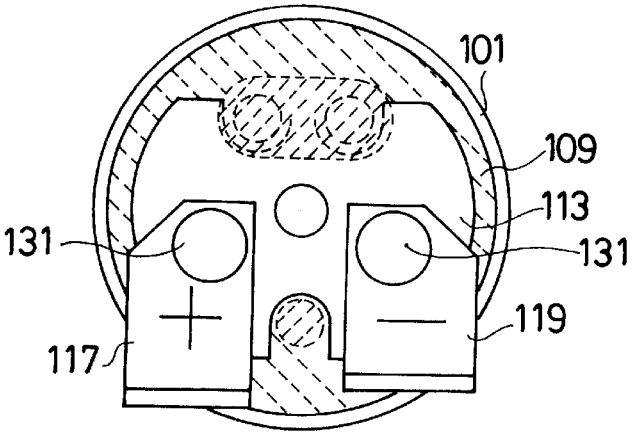
FIG. 28 (PRIOR ART)
FIG. 28 is a rear view of the electromagnetic type electroacoustic transducer according to the prior art, showing the positions of the lead terminals shifted from the proper positions.
Figure 29:
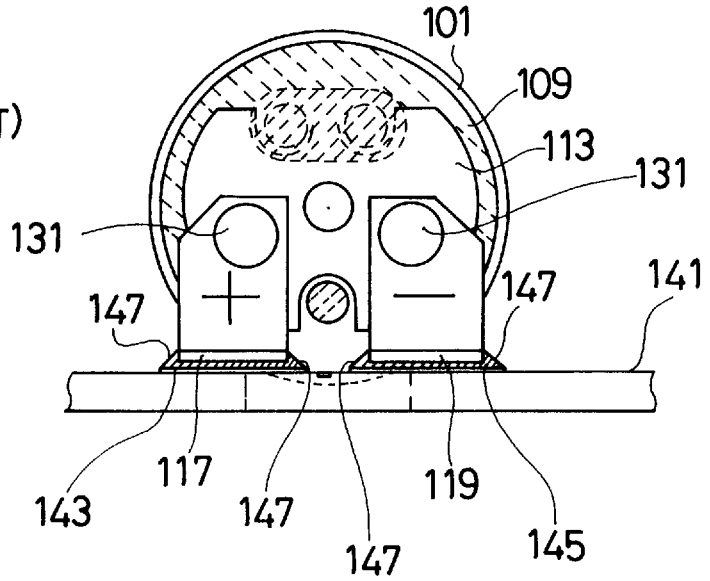
FIG. 29 (PRIOR ART)
FIG. 29 is a rear view of an electromagnetic type electroacoustic transducer showing the proper soldered portions.
Figure 30:
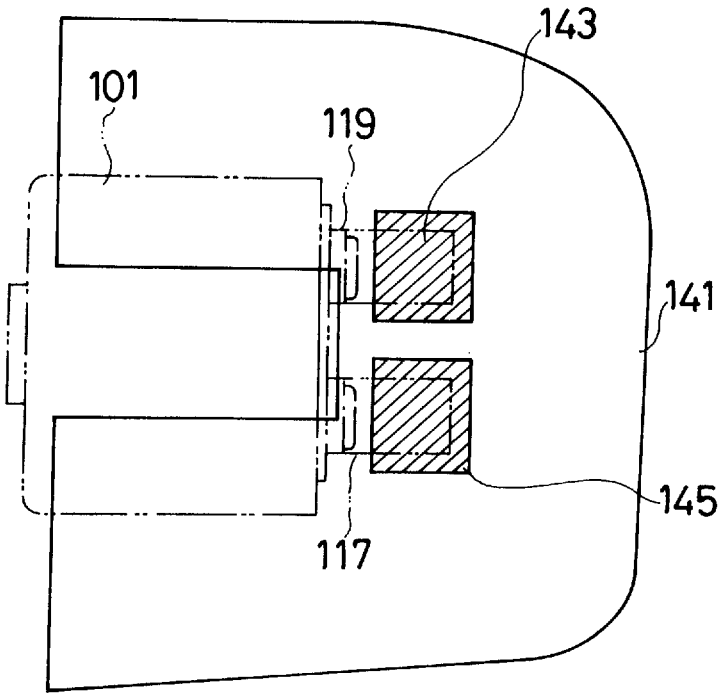
FIG. 30 (PRIOR ART)
FIG. 30 is a plan view illustrating a circuit board on which an electromagnetic type electroacoustic transducer is to be installed.
Figure 31:
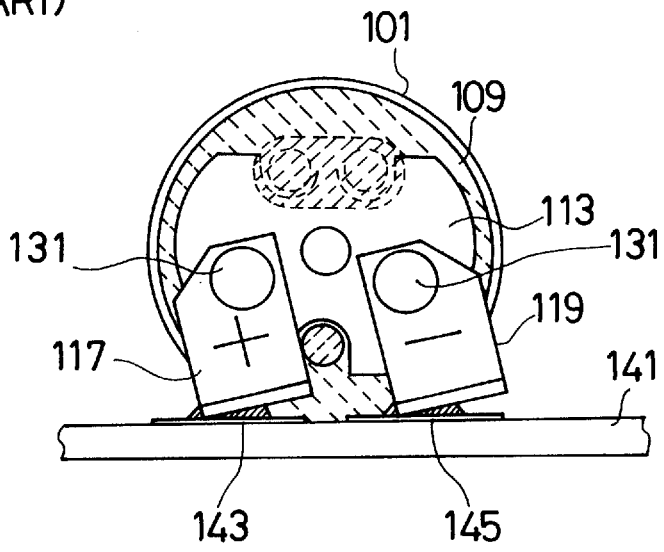
FIG.31 (PRIOR ART)
FIG. 31 is a rear view of the electromagnetic type electroacoustic transducer according to the prior art, showing improper soldering.
Figure 32:
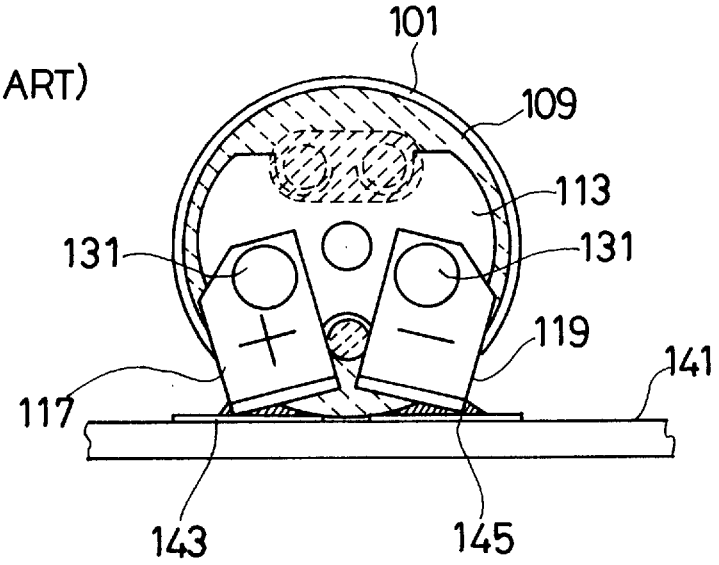
FIG.32 (PRIOR ART)
FIG. 32 is a rear view of the electromagnetic type electroacoustic transducer according to the prior art, showing improper soldering.
Figure 33:
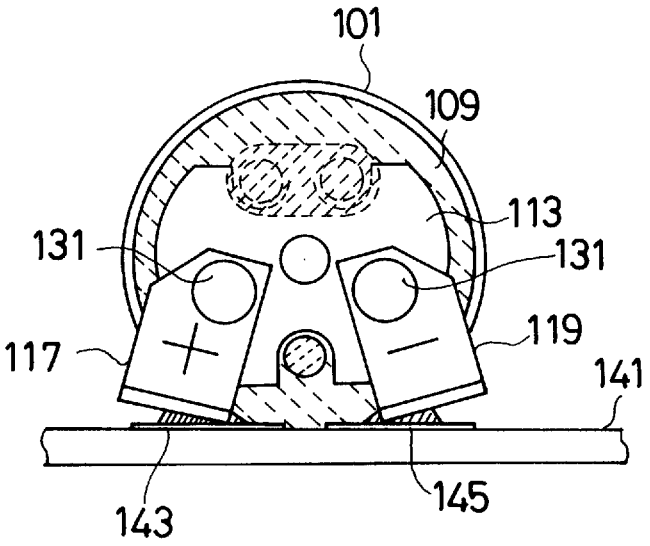
FIG.33 (PRIOR ART)
FIG. 33 is a rear view of the electromagnetic type electroacoustic transducer according to the prior art, showing improper soldering.
Figure 34:
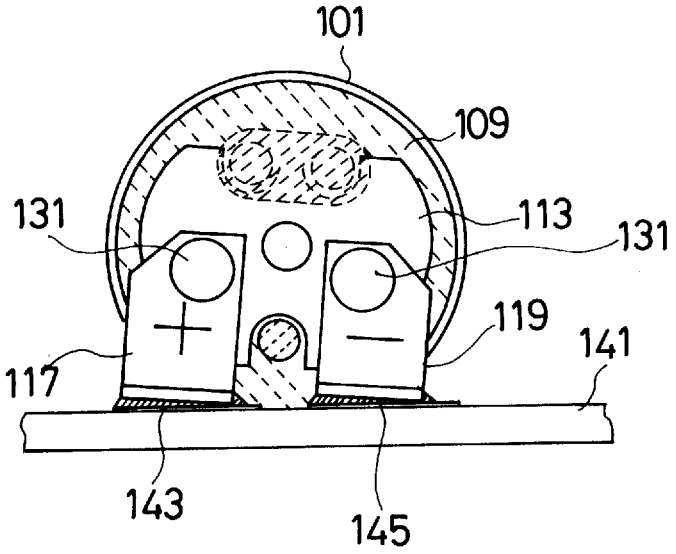
FIG.34 (PRIOR ART)
FIG. 34 is a rear view of the electromagnetic type electroacoustic transducer according to the prior art, showing improper soldering.

Next, the magnet wire (coil 15) is securely adhered on the outer surface of the core 11 (step S4). The process then proceeds to step S5 where the lead terminal member 33 is fixed to the circuit board 13 and the ends 15*a* and 15*b* of the magnet wire are securely soldered to the respective lead terminals 17 and 19 of the lead terminal member 33 via the circuit board 13. The state at this stage is illustrated in FIG. 17.

Figure 8:
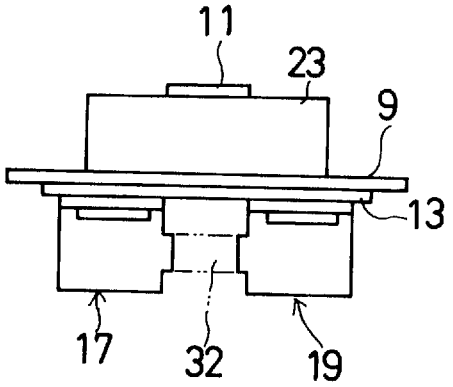
FIG. 8 is a front view of an electromagnetic type electroacoustic transducer showing a state after the bridge piece of the lead terminal member is cut in the process of assembling the electromagnetic type electroacoustic transducer according to the first embodiment of this invention.
Figure 9:
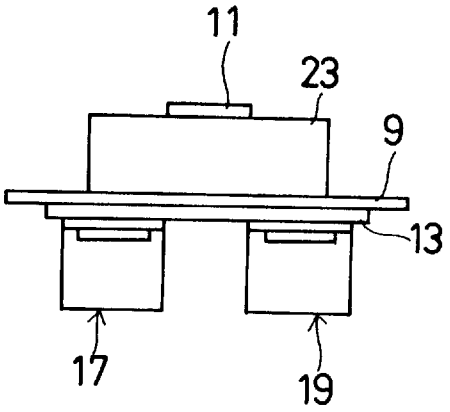
FIG. 9 is a front view of an electromagnetic type electroacoustic transducer showing a state after the bridge piece of the lead terminal member is cut and the cut portions are treated in the process of assembling the electromagnetic type electroacoustic transducer according to the first embodiment of this invention.
Figure 10:
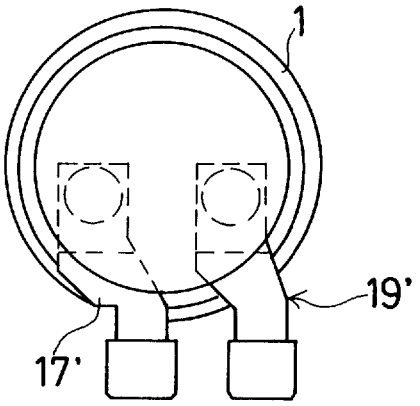
FIG. 10 is a rear view of an electromagnetic type electroacoustic transducer, illustrating the second embodiment of this invention.
Figure 11:
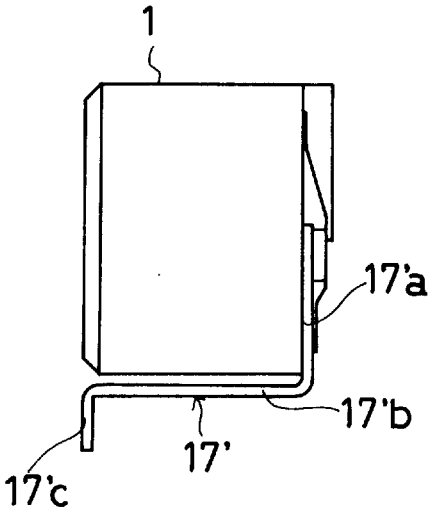
FIG. 11 is a side view of the electromagnetic type electroacoustic transducer according to the second embodiment of this invention.
Figure 12:
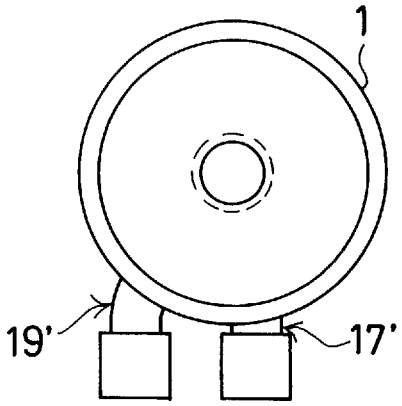
FIG. 12 is a front view of the electromagnetic type electroacoustic transducer according to the second embodiment of this invention.
Figure 13:
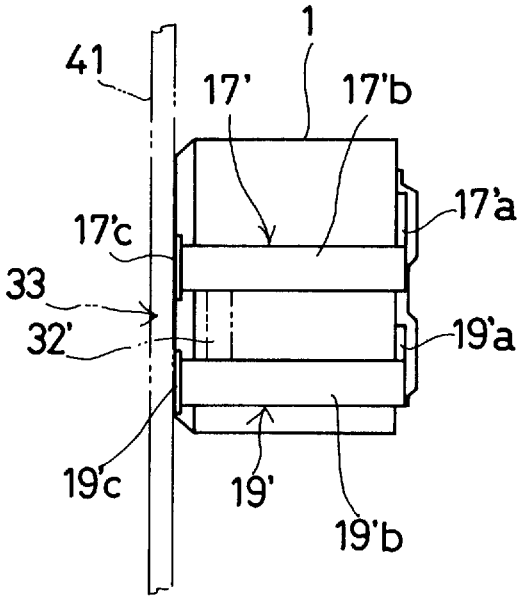
FIG. 13 is a side view of the electromagnetic type electroacoustic transducer according to the second embodiment of this invention.

At this stage, the bridge piece 32 of the lead terminal member 33 is cut by an unillustrated cutting machine (step S6). The resultant state becomes as illustrated in FIG. 8, and the cut portions are then treated to provide the resultant structure as shown in FIG. 9. As a result, the lead terminals 17 and 19 become separate and independent parts for the first time. In the subsequent process, no positional deviation of the lead terminals 17 and 19 occurs because the lead terminals 17 and 19 are securely soldered to the circuit board 13.

This embodiment has the following advantages.

The lead terminals 17 and 19 are integrated as the lead terminal member 33 by means of the bridge piece 32 until the lead terminals 17 and 19 are securely soldered to the circuit board 13. When the lead terminals 17 and 19 are attached to the circuit board 13 by the eyelet metal fittings 31, when the lead terminals 17 and 19 are placed on a soldering palette, or when both ends 15*a* and 15*b* of the coil 15 are securely connected via the circuit board 13 to the lead terminals 17 and 19 by soldering, for example, the lead terminals 17 and 19 can be prevented from being accidentally and undesirably shifted from the proper positions. This is because the lead terminals 17 and 19 interact to suppress their movements. Even when the electromagnetic type electroacoustic transducer completed through the above-described assembling process is installed on a circuit board 41 of another device (indicated by the imaginary line in FIG. 1) and is securely connected to circuit patterns thereon by soldering, excellent soldering can be acquired. It is therefore possible to effectively eliminate a conduction failure or insufficient securing power (holding power), which should be coped with according to the prior art.

As the lead terminals 17 and 19 are integrated as the lead terminal member 33 by means of the bridge piece 32, the lead terminals 17 and 19 have the same sizes and bending angles and the work of attaching the lead terminals 17 and 19 to the circuit board 13 by the eyelet metal fittings becomes simpler. Further, the lead terminals 17 and 19 are actually one piece, thus facilitating the parts management.

Second Embodiment

The second embodiment of the present invention will now be described with reference to FIGS. 10 through 13.

To avoid the redundant description, like or same reference numerals are given to those components which are the same as the corresponding components of the first embodiment.

This embodiment differs from the first embodiment in the shapes of the lead terminals 17' and 19'. Specifically, the lead terminal 17' has a first piece 17'*a*, a second piece 17'*b* bent from the first piece 17'*a*, and a third piece 17'*c* bent from this second piece 17'*b*. Likewise, the lead terminal 19' has a first piece 19'*a*, a second piece 19'*b* bent from the first piece 19'*a*, and a third piece 19'*c* bent from this second piece 19'*b*. As indicated by the imaginary line in FIG. 13, the second pieces 17'*b* and 19'*b* are coupled by a bridge piece 32'. That is, the lead terminals 17' and 19' are previously structured as an integrated lead terminal member 33'.

The timing at which the bridge piece 32' is cut is the same as the one in the first embodiment. The second embodiment with such a structure can have the same advantages as the first embodiment, so that excellent soldering can be acquired even when the assembled electromagnetic type electroacoustic transducer is installed on the circuit board 41 of another device (indicated by the imaginary line in FIG. 13) and is securely connected to circuit patterns thereon by soldering. It is therefore possible to effectively eliminate a conduction failure or insufficient securing power (holding power), which should be coped with according to the prior art.

The feature of the second embodiment lies in that the bridge piece 32' is provided as much apart as possible from the solder surfaces (the third pieces 17'*c* and 19'*c* of the lead terminals 17' and 19') which are to be placed on and soldered to the surface of a circuit board of another device where the electromagnetic type electroacoustic transducer is to be installed. Thus, the structure for providing this arrangement, such as the bent angles and lengths of the individual pieces, and the number of the individual pieces should properly be set according to the need.

Third Embodiment

Figure 14:
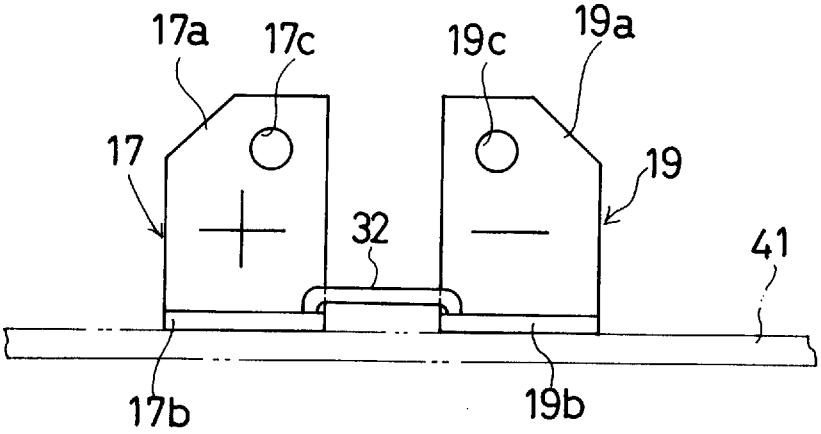
FIG. 14 is a front view of a lead terminal member according to the third embodiment of this invention.
Figure 15:
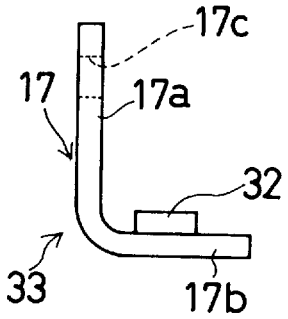
FIG. 15 is a side view of the lead terminal member according to the third embodiment of this invention.
Figure 16:
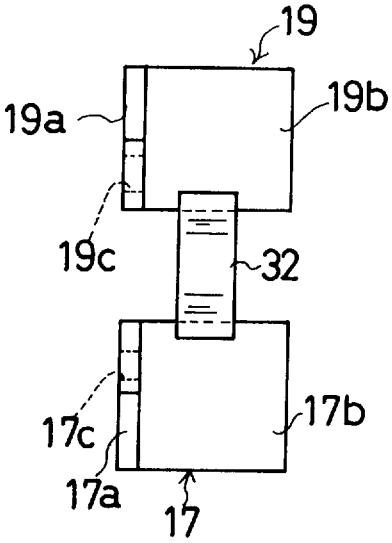
FIG. 16 is a top view of the lead terminal member according to the third embodiment of this invention.

The third embodiment of the present invention will now be described with reference to FIGS. 14 through 16.

To avoid the redundant description, like or same reference numerals are given to those components which are the same as the corresponding components of the first embodiment.

In this embodiment, the bridge piece 32 of the lead terminal member 33 in the first embodiment is bent so that the bridge piece 32 is lifted from the solder surfaces which are to be placed on and soldered to the surface of the circuit board 41 (indicated by the imaginary line in FIG. 14) of another device on which the electromagnetic type electroacoustic transducer is to be installed. This feature is designed to cope with a possible low solderability in the first embodiment at the time the bridge piece 32 is cut and removed, thus exposing the metal portions from the cut surfaces. (It is however to be noted that such a low solderability does not raise a significant problem because the portion with the low solderability is just a small part of the whole soldered portions.)

As the bridge piece 32 in the third embodiment is arranged off the solder surfaces, if the bridge piece 32 is cut and removed, exposing metal portions from the cut surfaces, the exposed portions (cut surface portions) are not the target areas for soldering at the time the electromagnetic type electroacoustic transducer is soldered to the circuit board 41. This structure can therefore overcome the aforementioned low solderability which may occur at the soldering time, thus ensuring firmer attachment.

This invention is not limited to the first to third embodiments. The foregoing descriptions of the first to third embodiments have discussed examples of a lead terminal member which has a pair of lead terminals integrated by means of a bridge piece, and those examples are to be considered as illustrative and not restrictive. For example, the position, the quantity, the size and the like of the bridge piece should be set as needed.

Although the electromagnetic type electroacoustic transducer has been illustrated as one example of electroacoustic transducers, this invention can be adapted to other types of electroacoustic transducers, such as a electric conduction type and a piezo type, as well.

Other ways than the eyelet structure may also be employed for the temporary attachment of the lead terminal member.

What is claimed is:

1. A lead terminal connection structure of an electroacoustic transducer provided with at least a pair of lead terminals electrically independent of each other, comprising:

a lead terminal member having the pair of lead terminals integrated via a connecting member, said lead terminals having mounting surfaces to be electrically connected with a device on which the electroacoustic transducer is to be mounted, and wherein said connecting member is operative to be cut so that said lead terminals can be separated from each other.

2. A lead terminal connection structure of an electroacoustic transducer provided with at least a pair of lead terminals electrically independent of each other, comprising:

a lead terminal member having the pair of lead terminals integrated via a connecting member, said lead terminals having mounting surfaces to be electrically connected with a device on which the electroacoustic transducer is to be mounted, wherein said connecting member is operative to be cut so that said lead terminals can be separated from each other, and wherein a cut surface of said connecting member is not connected to said mounting surfaces of said lead terminals.

3. The lead terminal connection structure of an electroacoustic transducer as claimed in claim 1, wherein said mounting surfaces are formed on the same plane.

4. The lead terminal connection structure of an electroacoustic transducer as claimed in claim 1, wherein said connecting member is one of curved and bent.

5. The lead terminal connection structure of an electroacoustic transducer as claimed in claim 1, wherein said lead terminal member is secured to said electroacoustic transducer by an eyelet structure.

6. The lead terminal connection structure of an electroacoustic transducer as claimed in any one of claims 1 to 5, in combination with an electroacoustic transducer, wherein said electroacoustic transducer is an electromagnetic type.

7. The lead terminal connection structure of an electroacoustic transducer as claimed in any one of claims 1 to 5, in combination with an electroacoustic transducer, wherein said electroacoustic transducer is an electric conduction type.

8. The lead terminal connection structure of an electroacoustic transducer as claimed in any one of claims 1 to 5, in combination with an electroacoustic transducer, wherein said electroacoustic transducer is a piezo type.

9. A lead terminal connection structure of an electroacoustic transducer comprising:

a lead terminal member having a pair of lead terminals integrated via a connecting member, said lead terminals having mounting surfaces to be mounted to a device on which the electroacoustic transducer is to be mounted, said lead terminals each comprising a longitudinal axis, a first end substantially perpendicular to said longitudinal axis, a second end opposite said first end, and a side adjacent both said first end and said second end, wherein said connecting member is connected to said side of each lead terminal, and wherein said connecting member is operative to be cut so that said pair of lead terminals can be separated from each other.

10. A lead terminal connection structure of an electroacoustic transducer comprising:

a lead terminal member having a pair of lead terminals integrated via a connecting member, said lead terminals having mounting surfaces to be electrically connected with a device on which the electroacoustic transducer is to be mounted, wherein said connecting member is operative to be cut so that said lead terminals can be separated from each other, and wherein said connecting member is not connected to said mounting surfaces of said lead terminals.

11. The lead terminal connection structure of an electroacoustic transducer as claimed in claim 9, wherein said side of one lead terminal faces said side of the other lead terminal.

12. The lead terminal connection structure of an electroacoustic transducer as claimed in claim 9, wherein said connecting member is connected intermediate said first and second end of each lead terminal.

13. The lead terminal connection structure of an electroacoustic transducer as claimed in claim 9, wherein said mounting surfaces are provided around the periphery of each lead terminal.

14. The lead terminal connection of an electroacoustic transducer as claimed in claim 10, wherein said mounting surfaces are provided around the periphery of each lead terminal.

15. The lead terminal connection structure of an electroacoustic transducer as claimed in claim 4, wherein said connecting member is not on the same plane as that of one lead terminal mounting surface.

16. A method for connecting lead terminals to an electroacoustic transducer comprising:

connecting a pair of lead terminals by a connecting member, thereby forming a lead terminal member, mounting the lead terminal member on the electroacoustic transducer, and then cutting the connecting member of the lead terminal member, thereby forming electrically independent lead terminals.

* * * * *